United States Patent [19]

O'Neil

[11] 4,082,113

[45] Apr. 4, 1978

[54] TIMING DEVICE WITH TRIPPING MECHANISM FOR FLUID VALVE

[75] Inventor: Charles P. O'Neil, Milwaukee, Wis.

[73] Assignee: Amerace Corporation, New York, N.Y.

[21] Appl. No.: 755,453

[22] Filed: Dec. 29, 1976

[51] Int. Cl.[2] ..... F15B 21/10

[52] U.S. Cl. ..... 137/624.11; 137/625.27; 251/73; 251/75

[58] Field of Search ..... 137/624.11, 624.12, 137/625.27, 625.5; 251/66, 73, 74, 75

[56] References Cited

U.S. PATENT DOCUMENTS 3,211,179 10/1965 Lilly ..... 251/74 X 3,801,064 4/1974 Harris ..... 251/74 X 3,931,832 1/1976 Hodler ..... 137/624.11

*Primary Examiner*—Alan Cohan

*Attorney, Agent, or Firm*—S. Michael Bender

[57] ABSTRACT

A timing device includes a timing means which effects movement of a motion transmitting member at a selected rate to provide a timed interval of selected duration, upon expiration of which interval a tripping mechanism, operated by the motion transmitting member, provides a positive biasing force for actuating and enhancing the operation of a fluid valve in controlling a fluid circuit. Means is provided for actuating the timing device in response to a relatively short-term activating pulse.

28 Claims, 7 Drawing Figures

TIMING DEVICE WITH TRIPPING MECHANISM FOR FLUID VALVE

The present invention relates generally to timing devices and pertains, more specifically, to time-delay devices of the type in which a fluid circuit is opened or closed after the lapse of a predetermined time interval following actuation of the device by a relay or some like actuating apparatus.

A variety of time-delay control apparatus is currently available in which a timing device is operated by an actuator to provide a timed interval between actuation of the timing device and the occurrence of some desired event, such as the operation of an electric switch. Among the most widely accepted of such control apparatus are those which employ a pneumatic timing device together with a solenoid actuator so that the timed interval can be measured either from activation or deactivation of the solenoid.

In certain environments, such as in the control of the flow of flammable fluids, and especially combustible gases, time-delay control apparatus is employed to open or close flow control valves. For example, fluid circuits for pilot flames in gas-burning systems are controlled by time-delay apparatus so that the fluid circuits are opened or closed after a time-delay interval measured from the occurrence of a given event, such as an interruption in gas flow. In such environments, the employment of electrical devices may present a hazard and it would be advantageous to have available a time-delay device which does not rely upon electrical components for its operation.

Pneumatic timing mechanisms which provide accurately measured intervals for time-delay purposes without the use of electrical components are especially well-suited for use in environments where electrical components are unnecessary, undesirable or dangerous. The utilization of such pneumatic timing mechanisms for the control of fluids requires a reliable valve which is easily operated by a pneumatic timing mechanism to provide positive actuation between open and closed positions with no deleterious effect upon the functioning of the timing mechanism.

A timing device in which a valve is operated by a time-delay device to open or close a fluid circuit upon the lapse of a predetermined timed interval following actuation of the device is disclosed in an earlier application, Ser. No. 658,773, filed Feb. 17, 1976, and assigned to the assignee of the instant application. It is an object of the present invention to provide a timing device of similar design and construction, but incorporating improvements which enhance performance and increase the range of uses of the device.

Another object of the invention is to provide a timing device of the type described with an improved tripping mechanism for a fluid valve employed in the timing device, the tripping mechanism enabling enhanced valve operation without affecting the accuracy and reliability of the time-delay mechanism.

Still another object of the invention is to provide a timing device of the type described wherein the improved tripping mechanism provides more positive valve operation and increases the sealing effectiveness of a closed valve.

A further object of the invention is to provide a timing device of the type described wherein the tripping mechanism is readily adjustable for ease of calibration.

A still further object of the invention is to provide a timing device of the type described which will operate in response to a short-term pulse input, as opposed to a continuous, long-term activating input.

The above objects, as well as still further objects and advantages, are attained by the present invention which may be described briefly as providing, in a timing device for actuating a fluid valve upon expiration of a prescribed timed interval following a given event, the timing device including a frame, a motion transmitting member mounted in the frame for movement along a prescribed path of travel in either one of two directions between a first location and a second location, timing means on the frame coupled with the motion transmitting member for effecting movement of the motion transmitting member at a predetermined rate in one only of the two directions to establish the timed interval between the departure of the motion transmitting member from the first location thereof and the arrival of the motion transmitting member at the second location, and permitting return movement of the motion transmitting member from the second location to the first location at an unrestricted rate, a fluid valve having a valve seat, a valve element movable into and out of engagement with the valve seat so as respectively to close and open the fluid valve, and a valve-operating lever movable between a first position and a second position, the valve-operating lever being coupled with the valve element such that the fluid valve is open in the first position of the valve-operating lever and is closed in the second position of the valve-operating lever, the improvement comprising resilient biasing means biasing the valve-operating lever toward the second position thereof with a biasing force tending to close the fluid valve, a latch mounted upon the frame for movement between a first position, wherein the latch engages the valve-operating lever to retain the valve-operating lever in the first position thereof against the biasing force of the resilient biasing means, and a second position, wherein the latch is disengaged from the valve-operating lever to permit movement of the valve-operating lever to the second position thereof in response to the biasing force of the resilient biasing means, a trip arm carried by the motion transmitting member for movement therewith, and means coupling the trip arm with the latch for movement of the latch from the first position thereof toward the second position thereof in response to movement of the motion transmitting member from the first location toward the second location to place the latch at the second position thereof upon the arrival of the motion transmitting member at the second location, whereby the valve element will be biased against the valve seat by the biasing force of the resilient biasing means.

The invention will be understood more fully, while still further objects and advantages will become apparent, by reference to the following detailed description of embodiments of the invention illustrated in the accompanying drawing, in which.

Figure 1:
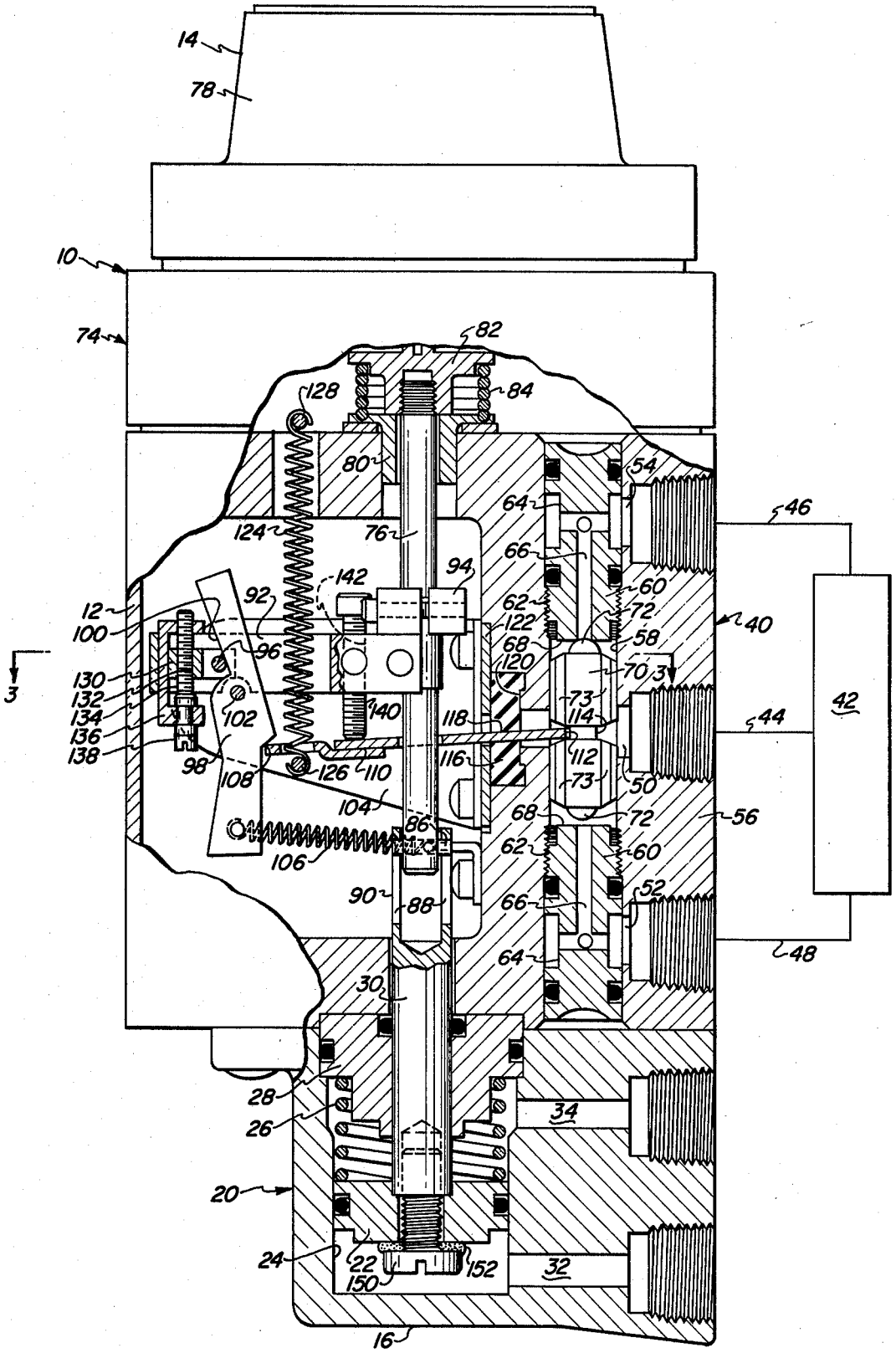
FIG. 1 is an elevational view of a timing device constructed in accordance with the invention, with portions broken away to reveal operating component parts thereof and a diagrammatic illustration of the environment in which the timing device is installed.

Referring now to the drawing, and especially to FIG. 1 thereof, a timing device constructed in accordance with the invention is illustrated at 10. Timing device 10 has a frame 12 extending longitudinally between an upper end 14 and a lower end 16 of the device.

Actuator means is shown in the form of a fluid actuator 20 at the lower end 16 of the timing device 10. Actuator 20 includes a piston 22 placed in a cylinder 24 for reciprocating movement in longitudinally upward and downward directions. Piston 22 is biased downwardly by a helical spring 26 which extends between the piston and a gland 28 which closes the cylinder 24 at the uppermost end thereof. An actuator rod 30 is affixed to the piston 22 and extends longitudinally upwardly through the gland 28, the actuator rod 30 being movable relative to the gland with movement of the piston. An inlet port 32 is provided for admitting a working fluid to the cylinder 24 below the piston 22 so as to urge the piston upwardly against the bias of spring 26. An alternate port 34 serves as a vent port and vents the cylinder above the piston to permit upward movement of the piston.

Figure 2:
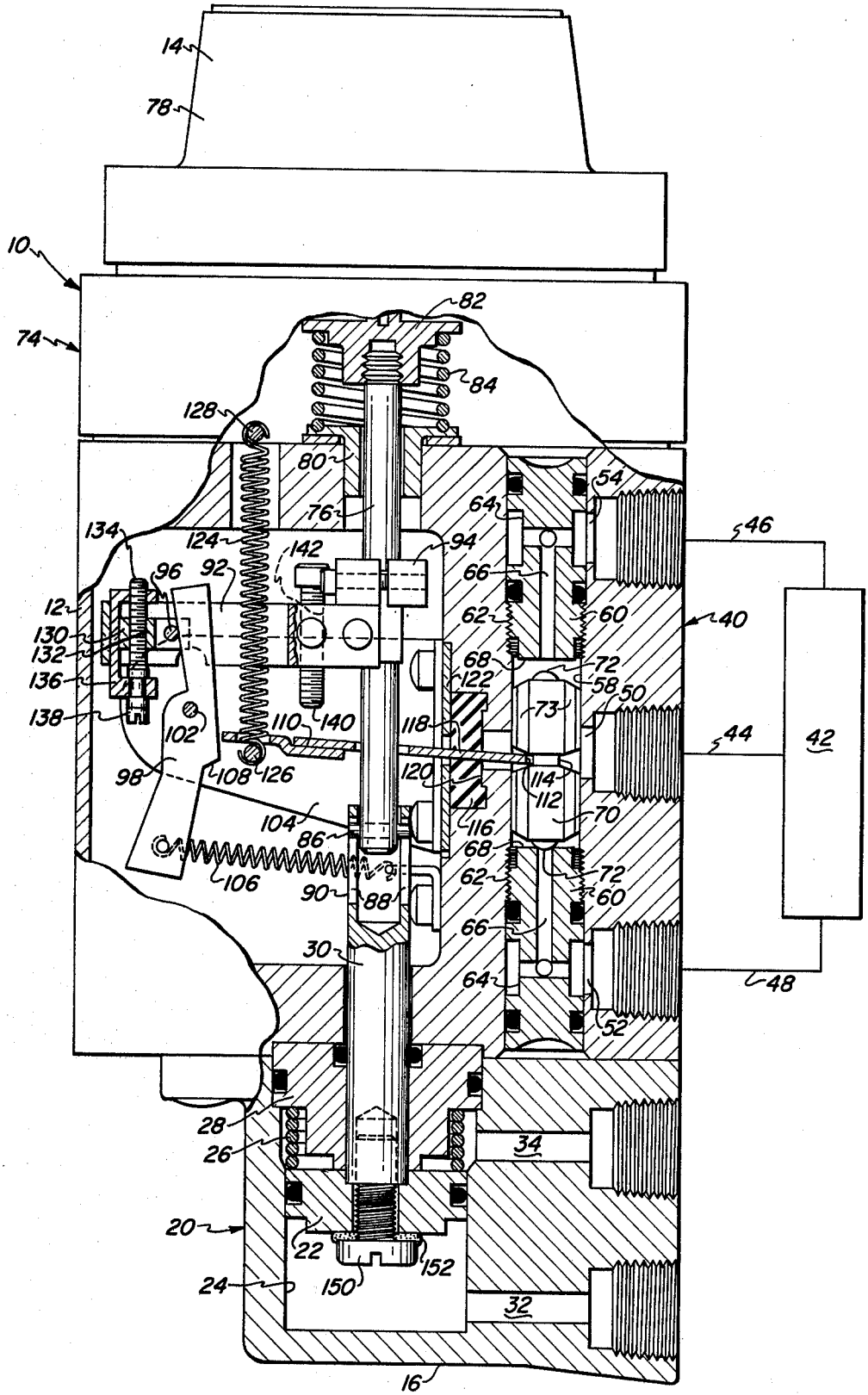
FIG. 2 is an elevational view similar to FIG. 1, but with the component parts in a different operating position.

In the configuration illustrated in FIGS. 1 and 2, timing device 10 is to operate a fluid valve to either close or open a fluid circuit after the lapse of a predetermined interval of time following activation of actuator 20 to move piston 22 from the lower or rest position seen in FIG. 1 to the upper or activated position seen in FIG. 2.

The fluid valve is shown at 40 and may be connected into a fluid circuit 42 through a common leg 44, illustrated as an input leg, and either one or both of alternate legs 46 and 48, illustrated as output legs, of the fluid circuit. Input leg 44 is thus connected to valve 40 at a first passage 50, which, in this instance, constitutes an inlet passage, while output legs 46 and 48 can be connected at alternate second passages 52 and 54, which, in this instance, would constitute outlet passages, in the valve body 56. Valve body 56 includes a valve chamber, shown in the form of a longitudinally extending cylindrical bore 58, and the passages 50, 52 and 54 communicate with the bore 58. A valve seat 60 is affixed within valve body 56 at each end of the bore 58, preferably by means of threaded connections at 62. Each valve seat 60 includes an annular groove 64 communicating with a respective second passage 52 or 54 and an internal conduit 66 extending between annular groove 64 and a seating portion in the form of seating end 68 of the valve seat 60.

A valve element in the form of a shuttle 70 is placed in the bore 58 and has an external configuration, portions of which are complementary to the bore to enable the shuttle to slide downwardly and upwardly within the bore. The shuttle 70 carries a sealing member in the form of a ball 72 of elastomeric material at each end of the shuttle, each ball 72 being in such axial alignment with each conduit 66 at seating end 68 of each valve seat 60 so that a ball 72 is seated against one or the other of the seats 60 to close the respective conduit 66. In the upper position of the shuttle, as seen in FIG. 1, the upper ball 72 is seated against the upper valve seat 60 to close the conduit 66 therein, and thereby close communication between second passage 54 and the chamber provided by bore 58. At the same time, communication between first passage 50 and second passage 52 remains open, via conduit 66 in the lower valve seat 60, bore 58 and longitudinal channels 73 in the external surface of shuttle 70 (also see FIG. 3).

Timing device 10 employs a time-delay mechanism, shown in the form of a pneumatic timing mechanism 74 at the upper end of device 10. Timing mechanism 74 is of a type now well-known in the art. A very similar pneumatic timing mechanism is described in U.S. Pat. No. 3,599,131, issued on Aug. 10, 1971, to Flanagan et al. A motion transmitting member in the form of a spindle 76 extends downwardly from timing mechanism 74 and it is the function of the timing mechanism to move spindle 76 from a lowermost location, as seen in FIG. 1, to an uppermost location, as seen in FIG. 2, at a timed rate of movement so that the elapsed time during such movement of spindle 76 corresponds to a selected time-delay interval. The duration of the interval is selected by setting a dial 78 at the top of the timing mechanism 74.

Spindle 76 passes through a bushing 80 and is affixed at its upper end to a collar 82, which is a part of the timing mechanism 74. A helical spring 84 biases the collar 82 and spindle 76 upwardly. The pneumatic arrangement in timing mechanism 74 enables upward movement of collar 82 and, therefore, spindle 76 from the lowermost location at a selected rate while permitting downward movement to the lowermost location, against the bias of spring 84, at an unrestricted rate. At its lower end, spindle 76 is coupled to actuator rod 30 by means of a yoke arrangement which includes a pin 86 affixed to the spindle 76 and passing through a pair of opposed longitudinal slots 88 in a sleeve-like portion 90 of the actuator rod 30. In the position of the parts illustrated in FIG. 1, the downward biasing force of spring 26 upon piston 22 maintains the piston and actuator rod 30 in the downward position and holds spindle 76 in the lowermost location, against the upward bias of spring 84, by virtue of the engagement of pin 86 with the uppermost ends of slots 88.

Upon activation of timing device 10, fluid (in this instance air) is introduced into cylinder 24 of actuator 20 through inlet port 32 under pressure so as to raise piston 22 against the bias of spring 26 and thereby actuate rod 30 to move the rod to an uppermost position, as illustrated in FIG. 2. Such upward movement of rod 30 takes place almost instantaneously and frees the spindle 76 for upward movement, in response to the upward bias of spring 84, at a predetermined rate, the pin 86 now being able to move upwardly within slots 88 in rod 30.

Figure 3:
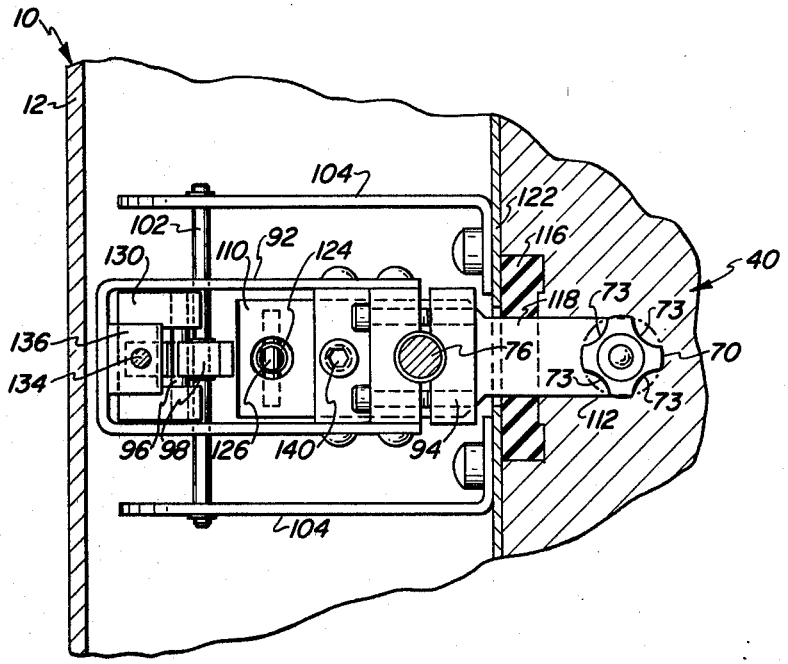
FIG. 3 is a fragmentary cross-sectional view taken along line 3—3 of FIG. 1.

As best seen in FIG. 3, as well as in FIGS. 1 and 2, a U-shaped trip arm 92 is affixed to spindle 76 by means of a clamp 94 and is thereby carried by the spindle 76 for upward movement with the spindle at the same rate of movement. A drive member in the form of a bearing pin 96 is carried by the trip arm 92, at the other end thereof, and moves upwardly with the trip arm 92 and the spindle 76.

Bearing pin 96 is engaged with a latch 98 at a drive surface 100 of the latch 98. Latch 98 is journaled upon a shaft 102 which extends between a pair of mounting brackets 104 secured to frame 12 so that latch 98 can pivot about the axis of the shaft 102, which axis is perpendicular to the plane of the paper and perpendicular to the direction of movement of spindle 76.

Latch 98 is biased in a counterclockwise direction (as viewed in FIGS. 1 and 2) by resilient biasing means in the form of a helical spring 106 extending between the lower end of the latch and the frame 12 to urge a latching shoulder 108 into latching engagement with a valve-operating lever 110. Valve-operating lever 110 extends through the wall of the valve body 56 and terminates within the valve 40 at a bifuricated end 112 which engages shuttle 70 within an annular recess 114 in the shuttle. Lever 110 is held in place by a support block 116 of elastomeric material which surrounds intermediate portion 118 of lever 110 and is seated in a cavity 120 within the wall of the valve body 56. The resilient, flexible nature of the material of block 116 allows lever 110 to swing about an axis perpendicular to the plane of the paper, as viewed in FIGS. 1 and 2, while intimate contact between the material of block 116 and portion 118 of lever 110 serves as a seal which seals the valve body against leakage along the lever 110 between the valve chamber provided by bore 58 and the exterior of the valve. Block 116 is retained within cavity 120 by a plate 122 and preferably is placed under compression within the cavity so as to assure intimate sealing contact between the block 116 and portion 118 of lever 110. In order to simplify construction, as well as to assure proper sealing and effective operation, block 116 may be molded around portion 118 to fabricate an integral lever 110 and block 116 assembly.

Valve-operating lever 110 is biased upwardly, in a clockwise direction as viewed in FIGS. 1 and 2, by resilient biasing means in the form of a helical valve spring 124. Valve spring 124 has a lower end secured to valve-operating lever 110 at 126 and an upper end secured to frame 12 at 128. When the spindle 76 is at the location shown in FIG. 1, latch 98 is in a first position wherein latching shoulder 108 engages valve-operating lever 110 and retains lever 110 in its first position. During initial upward movement of spindle 76 from the location shown in FIG. 1 toward the location shown in FIG. 2, latch 98 will retain valve-operating lever 110 in its first position.

Continued upward movement of spindle 76 and concomitant upward movement of trip arm 92 will cause bearing pin 96 to drive latch 98 clockwise about shaft 102, thereby releasing the engagement between latching shoulder 108 and valve-operating lever 110. As soon as valve-operating lever 110 is released from latch 98, the positive biasing force of valve spring 124 will very quickly swing valve-operating lever 110 in a clockwise direction to immediately move shuttle 70 from the first or uppermost position, seen in FIG. 1, to the second or lowermost position, seen in FIG. 2. Such movement of the shuttle will seat the lower ball 72 against the seating end 68 of the lower valve seat 60 to close the conduit 66 therein, and thereby close communication between second passage 52 and the chamber provided by bore 58, thus closing off communication between first passage 50 and second passage 52. At the same time, communication between first passage 50 and second passage 54 is opened. In this manner, valve 40 operates to switch the fluid circuit 42 to change the communication between common leg 44 of the circuit and the alternate legs 46 and 48. Since the positive biasing force of valve spring 124 is transmitted directly to lower ball 72, through valve-operating lever 110 and shuttle 70, the biasing force directly exerts a valve sealing force tending to enhance the seal between lower ball 72 and corresponding lower valve seat 60. Thus, the tripping mechanism provided by trip arm 92, bearing pin 96, latch 98, and the associated component parts described above, enables valve spring 124 to provide a snap-action actuation of valve 40 together with a relatively strong positive valve sealing force, while still enabling tripping to take place in response to the relatively light forces exerted by the relatively slow upward movement of spindle 76. The relative location of the bearing pin 96, the pivot provided by shaft 102 and the latch biasing spring 106, together with the relatively light biasing force supplied by spring 106, assures that accurate movement of spindle 76, in response to timing mechanism 74, is not impeded.

In order to assure that valve 40 is actuated precisely at the expiration of a predetermined timed interval following activation of timing device 10, the location of bearing pin 96 is adjustable upwardly and downwardly relative to trip arm 92 and the spindle 76. Thus, bearing pin 96 is carried by a carriage 130 having a threaded aperture 132 engaged by a lead screw 134 secured in a bracket 136 on the trip arm 92. Rotation of lead screw 134, by engagement of an appropriate driving tool (not shown) in slotted head 138, provides a vernier adjustment of the location of bearing pin 96 for precise calibration of the tripping mechanism.

Upon deactivation of timing device 10, the working fluid in cylinder 24 is released to permit the piston 22 to move downwardly, under the biasing force of spring 26, thereby moving actuator rod 30 downwardly until the yoke provided by slots 88 in portion 90 of rod 30 engage pin 86 in spindle 76 and pull spindle 76 downwardly until the component parts return to the initial position illustrated in FIG. 1. Since the timing mechanism 74 does not impede downward movement of spindle 76, such movement can occur rapidly. The rapid downward movement of spindle 76 brings trip arm 92 rapidly downward so that a reset means in the form of threaded pin 140 carried by trip arm 92 can engage valve-operating lever 110 and quickly move the lever 110 to the initial position shown in FIG. 1 and return the shuttle 70 back to the upper position. Because reset pin 140 is threaded into a complementary threaded aperture 142 in trip arm 92, the position of reset pin 140 relative to trip arm 92 can be adjusted to accurately locate the initial position of valve-actuating lever 110. At the same time, such adjustment enables the biasing force of spring 26 to be transmitted directly to upper ball 72, through valve-operating lever 110 and shuttle 70, so as to exert a positive valve sealing force tending to enhance the effectiveness of the seal between upper ball 72 and corresponding upper valve seat 60.

Figure 4:
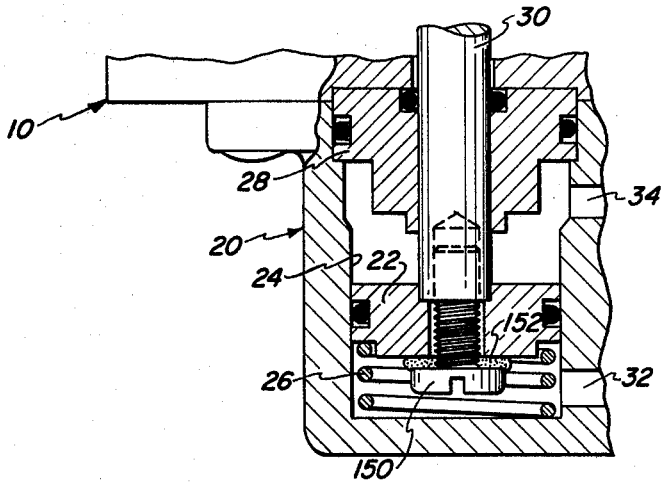
FIG. 4 is a fragmentary cross-sectional view of a portion of the timing device with certain component parts re-arranged for an alternate operating mode.

Turning now to FIG. 4, where it is desired to actuate valve 40 (not shown in FIG. 4) upon the expiration of an interval of time measured from the deactivation of timing device 10, rather than from activation of the device 10 as described above, the location of spring 26 is changed from between the piston 22 and gland 28 to below the piston 22, as illustrated in FIG. 4. In this manner, spring 26 exerts an upwardly directed biasing force upon the piston 22. However, upward movement of the piston 22 in response to the biasing force of spring 26 is resisted by the presence of a working fluid introduced into cylinder 24 above the piston 22, via the alternate port 34. Thus, as long as the timing device 10 remains activated; that is, as long as working fluid under pressure is maintained in the cylinder 24 above the piston 22, the timing mechanism 74, spindle 76 and valve 40 will remain in the positions illustrated in FIG. 1.

Upon deactivation of timing device 10; that is, upon release of the working fluid from the cylinder 24 above the piston 22, spring 26 will immediately move piston 22 to the uppermost position of the piston, releasing the spindle 76 and enabling the timing mechanism 74 to operate so as to move spindle 76 upwardly toward the uppermost location thereof and actuate valve 40, all as described hereinabove. Hence, valve 40 will be actuated following the expiration of a predetermined timed interval measured from deactivation of the timing device 10.

In order to facilitate the relocation of spring 26 between the two locations set forth above, piston 22 is secured to actuator rod 30 by means of a screw 150 which is easily removed to enable withdrawal of the piston 22 from actuator rod 30 for access to the portion of cylinder 24 above piston 22. A seal 152 assures fluid-tight assembly of the piston 22 and actuator rod 30.

Figure 5:
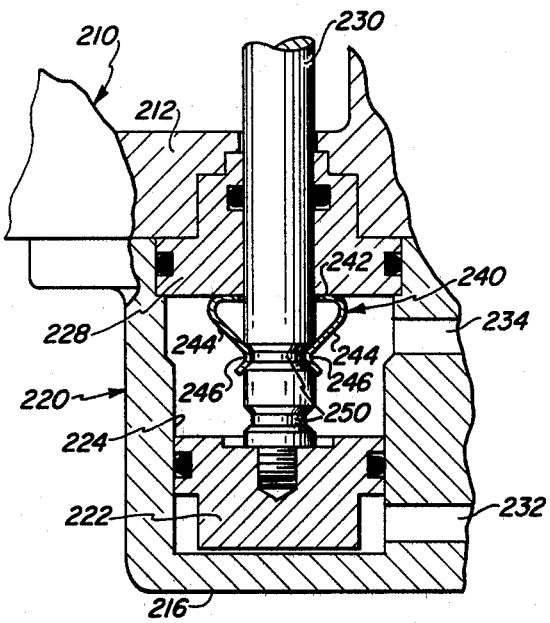
FIG. 5 is a fragmentary cross-sectional view of a portion of an alternate timing device constructed in accordance with the invention.
Figure 6:
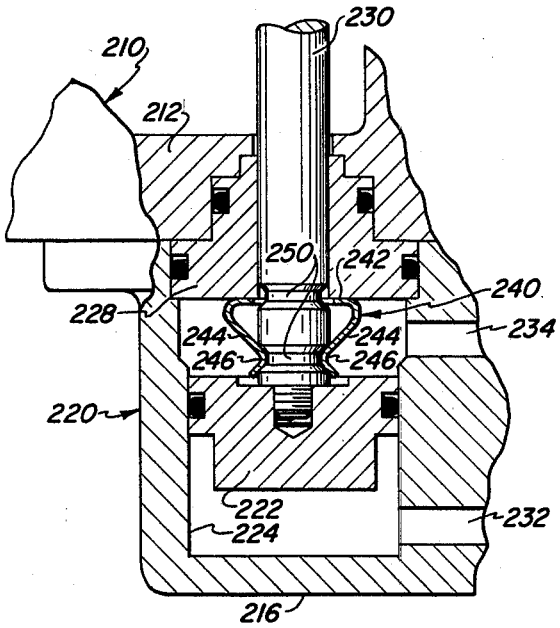
FIG. 6 is a fragmentary cross-sectional view similar to FIG. 5, but with the component parts in another operating position.
Figure 7:
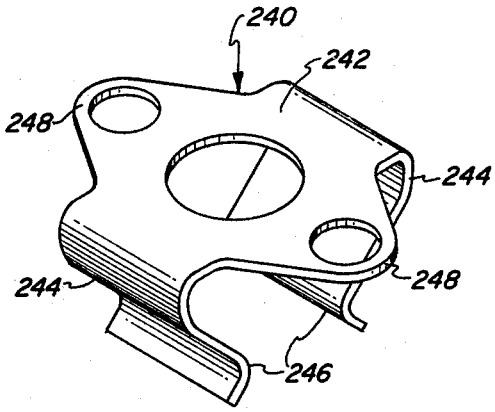
FIG. 7 is a perspective view of a component part of the timing device of FIG. 5.

Referring now to FIGS. 5 through 7, an alternate arrangement is illustrated for the actuator means at the lower end of the timing device, the alternate arrangement enabling the timing device to be actuated in response to short-term activating pulses, as opposed to the long-term actuating forces required in the embodiment illustrated in FIGS. 1 through 4.

In the device illustrated in FIGS. 1 through 3, working fluid admitted through inlet port 32 to cylinder 24 below piston 22 to move piston 22 upwardly must remain in cylinder 24 to retain piston 22 in the uppermost position, against the downward bias of spring 26. Not until after the expiration of the predetermined timed interval and actuation of valve 40 is the working fluid released from cylinder 24 to allow spring 26 to reset the device. Likewise, in the configuration of FIG. 4, a working fluid must be present in the portion of cylinder 24 above piston 22 to maintain the piston 22 in the lowermost position against the bias of spring 26. In both instances, the forces provided by the working fluid are long-term activating forces.

In order to enable the timing device to respond to relatively short-term activating pulses, the alternate arrangement of FIGS. 5 through 7 provides a fluid actuator 220 at the lower end 216 of timing device 210 which, in all other respects is similar to timing device 10. Fluid actuator 220 includes a piston 222 placed in a cylinder 224 for reciprocating movement upwardly and downwardly. A gland 228 closes the cylinder at the uppermost end thereof and an actuator rod 230, affixed to piston 222, extends upwardly through the gland 228 to be coupled to the spindle (not shown) of the timing device in the same manner as described above. A first inlet port 232 is provided for admitting a working fluid to the cylinder 224 below the piston 222 and a second inlet port 234 is provided above the piston 222.

Piston 222 is movable in cylinder 224 between a lower position, shown in FIG. 5, and an upper position, shown in FIG. 6. The piston 222, and actuator rod 230, are retained in each of the lower and upper positions by resilient detent means having detent elements located on the frame 212 and on the actuator rod 230 as follows. A spring member 240 has a base 242 from which there projects a pair of resiliently deflectable arms 244, each carrying a detent projection 246. The base 242 is secured to frame 212 by fasteners (not shown) passing through ears 248 (see FIG. 7) of base 242. The actuator rod 230 is provided with a pair of detent notches 250 spaced apart axially a distance equivalent to the travel of the piston 222, each detent notch 250 being complementary to the detent projections 246.

Upon introducing working fluid into inlet port 232, piston 222 will be moved upwardly from the lower position to the upper position. Since the piston 222, and actuator rod 230, will be retained in the upper position by engagement of the detent projections 246 with the lower detent notch 250, as seen in FIG. 6, working fluid need not be maintained in the cylinder 224 below piston 222 in order for the timing device to complete its timing cycle. Thus, only a short-term activating pulse of working fluid is required to activate timing device 210 and enable the valve (not shown) of the timing device to be actuated at the expiration of a predetermined timed interval following the activating pulse. Reset is achieved by introducing a working fluid into the cylinder 224 through second inlet port 234 to move piston 222 downwardly to the lower position shown in FIG. 5, where the piston 222 and actuator rod 230 are retained by engagement of the detent projections 246 with upper detent notch 250. Again, only a pulse is required since the piston and actuator rod are retained at the lower position.

It is noted that the illustrated embodiments employ a fluid-operated timing mechanism to actuate a fluid valve in response to activation or deactivation of a fluid actuator. Since all of the components are operated by fluid, or handle a fluid, no electrical devices are required. Thus, timing devices 10 and 210 are well-suited to installations where electrical components would introduce a hazard. Of course, where no hazard would exist, fluid actuator 20 could be replaced with an electrical actuator such as a solenoid.

It is to be understood that the above detailed description of embodiments of the invention is provided by way of example only. Various details of design and construction may be modified without departing from the true spirit and scope of the invention, as set forth in the appended claims.

The embodiments of the invention in which an exclusive property or privilege is claimed are defined as follows.

1. In a timing device for actuating a fluid valve upon expiration of a prescribed timed interval following a given event, the timing device including a frame;

a motion transmitting member mounted in the frame for movement along a prescribed path of travel in either one of two directions between a first location and a second location;

timing means on the frame coupled with the motion transmitting member for effecting movement of the motion transmitting member at a predetermined rate in one only of said two directions to establish said timed interval between the departure of said motion transmitting member from the first location thereof and the arrival of the motion transmitting member at the second location, and permitting return movement of the motion transmitting member from the second location to the first location at an unrestricted rate;

a fluid valve having a valve seat, a valve element movable into and out of engagement with the valve seat so as respectively to close and open the fluid valve, and a valve-operating lever movable between a first position and a second position, the valve-operating lever being coupled with the valve element such that the fluid valve is open in the first position of the valve-operating lever and is closed in the second position of the valve-operating lever;

the improvement comprising:

resilient biasing means biasing the valve-operating lever toward the second position thereof with a biasing force tending to close the fluid valve;

a latch mounted upon the frame for movement between a first position, wherein the latch engages the valve-operating lever to retain the valve-operating lever in the first position thereof against the biasing force of the resilient biasing means, and a second position, wherein the latch is disengaged from the valve-operating lever to permit movement of the valve-operating lever to the second position thereof in response to the biasing force of the resilient biasing means;

a trip arm carried by the motion transmitting member for movement therewith; and means coupling the trip arm with the latch for movement of the latch from the first position thereof toward the second position thereof in response to movement of the motion transmitting member from the first location toward the second location to place the latch at the second position thereof upon the arrival of the motion transmitting member at the second location, whereby the valve element will be biased against the valve seat by the biasing force of the resilient biasing means.

2. The invention of claim 1 wherein the resilient biasing means is a spring extending between the frame and the valve-operating lever.

3. The invention of claim 1 including further resilient biasing means biasing the latch toward the first position thereof.

4. The invention of claim 1 wherein the latch is mounted upon the frame for pivotal movement between the first and second positions thereof about a pivotal axis.

5. The invention of claim 4 wherein the pivotal axis is perpendicular to the direction of movement of the motion transmitting member.

6. The invention of claim 4 wherein the latch includes a latching shoulder for engaging the valve-operating lever to retain the valve-operating lever in the first position thereof.

7. The invention of claim 6 wherein the coupling means includes a drive member carried by the trip arm and engaging a drive surface on the latch.

8. The invention of claim 7 wherein the pivotal axis of the latch is located between the latching shoulder and the drive surface.

9. The invention of claim 7 including vernier means for selectively adjusting the location of the drive member relative to the trip arm and the motion transmitting member to enable accurate adjustment of the disengagement of the valve-operating lever in relation to the location of the motion transmitting member.

10. The invention of claim 1 including reset means carried by the motion transmitting member for movement therewith as the motion transmitting member moves between the first and second locations, the reset means engaging the valve-operating lever during movement of the motion transmitting member from the second location back to the first location to move the valve-operating lever back to the first position thereof.

11. The invention of claim 10 wherein the reset means includes a pin carried by the trip arm and mounted for selective adjustment relative to the motion transmitting member to enable the accurate location of the first position of the valve-operating lever.

12. The invention of claim 1 wherein the timing device includes:

an actuator having actuating means movable between a first position and a second position;

coupling means coupling the actuating means with the motion transmitting member such that the motion transmitting member is retained in the first location thereof when the actuating means is in the first position and the motion transmitting member is free to move toward the second location thereof, under the influence of the timing means, when the actuating means is in the second position;

resilient detent means for retaining the actuating means with a predetermined retention force at the first and second positions thereof upon placement of the actuating means at either of the first and second positions; and activating means for enabling movement of the actuating means from one of the first and second positions to the other of the first and second positions by overcoming the predetermined retention force of the resilient detent means in response to activation of the actuator.

13. The invention of claim 12 wherein:

the actuator is a fluid actuator and has a piston movable within a cylinder having opposite ends, said actuating means including an actuator rod moved by the piston between said first position and said second position;

said coupling means couples the actuator rod with the motion transmitting member;

the resilient detent means includes complementary detent elements on the frame and on the actuator rod; and said activating means includes a first port for admitting a working fluid into the cylinder between the piston and one end of the cylinder and a second port for admitting a working fluid into the cylinder between the piston and the other end of the cylinder.

14. In a timing device for actuating a fluid valve upon expiration of a prescribed timed interval following a given event, the timing device including a frame;

a motion transmitting member mounted in the frame for movement along a prescribed path of travel in either one of two directions between a first location and a second location;

timing means on the frame coupled with the motion transmitting member for effecting movement of the motion transmitting member at a predetermined rate in one only of said two directions to establish said timed interval between the departure of said motion transmitting member from the first location thereof and the arrival of the motion transmitting member at the second location, and permitting return movement of the motion transmitting member from the second location to the first location at an unrestricted rate;

a fluid valve including a valve body having a chamber;

first and second passages communicating with the chamber;

a shuttle in said chamber movable between a first position, wherein communication is open between both said first and second passages and the chamber, and a second position, wherein the shuttle closes communication between one of said first and second passages and the chamber;

a valve-operating lever movable between a first position and a second position, the valve-operating lever being coupled with the shuttle such that the shuttle is in the first position thereof when the valve-operating lever is in its first position, and the shuttle is in the second position thereof when the valve-operating lever is in its second position;

the improvement comprising:

resilient biasing means biasing the valve-operating lever toward the second position thereof with a biasing force tending to retain the shuttle in its second position and close communication between said one of the first and second passages and the chamber;

a latch mounted upon the frame for movement between a first position, wherein the latch engages the valve-operating lever to retain the valve-operating lever in the first position thereof against the biasing force of the resilient biasing means, and a second position, wherein the latch is disengaged from the valve-operating lever to permit movement of the valve-operating lever to the second position thereof in response to the biasing force of the resilient biasing means;

a trip arm carried by the motion transmitting member for movement therewith; and means coupling the trip arm with the latch for movement of the latch from the first position thereof toward the second position thereof in response to movement of the motion transmitting member from the first location toward the second location to place the latch at the second position thereof upon the arrival of the motion transmitting member at the second location, whereby the shuttle will be biased into the second position thereof by the biasing force of the resilient biasing means.

15. The invention of claim 14 wherein:

the chamber comprises a bore extending longitudinally within the valve body and having opposite ends;

the shuttle is placed in the bore for sliding movement therein between said opposite ends;

the valve includes a valve seat adjacent one of said opposite ends of the bore, said valve seat having a seating portion at the chamber and a conduit extending between said one of the first and second passages and the seating portion;

said shuttle having a sealing member aligned with the conduit at the seating portion of the valve seat such that movement of the shuttle between the first and second positions thereof will move the sealing member out of and into engagement with the seating portion of the valve seat for opening and closing communication between the conduit and the chamber, with the resilient biasing means biasing the sealing member against the valve seat when the shuttle is in the second position thereof.

16. The invention of claim 14 wherein the resilient biasing means is a spring extending between the frame and the valve-operating lever.

17. The invention of claim 14 including further resilient biasing means biasing the latch toward the first position thereof.

18. The invention of claim 14 wherein the latch is mounted upon the frame for pivotal movement between the first and second positions thereof about a pivotal axis.

19. The invention of claim 18 wherein the pivotal axis is perpendicular to the direction of movement of the motion transmitting member.

20. The invention of claim 18 wherein the latch includes a latching shoulder for engaging the valve-operating lever to retain the valve-operating lever in the first position thereof.

21. The invention of claim 20 wherein the coupling means includes a drive member carried by the trip arm and engaging a drive surface on the latch.

22. The invention of claim 21 wherein the pivotal axis of the latch is located between the latching shoulder and the drive surface.

23. The invention of claim 21 including vernier means for selectively adjusting the location of the drive member relative to the trip arm and the motion transmitting member to enable accurate adjustment of the disengagement of the valve-operating lever in relation to the location of the motion transmitting member.

24. The invention of claim 14 including reset means carried by the motion transmitting member for movement therewith as the motion transmitting member moves between the first and second locations, the reset means engaging the valve-operating lever during movement of the motion transmitting member from the second location back to the first location to move the valve-operating lever back to the first position thereof.

25. The invention of claim 24 wherein:

the chamber comprises a bore extending longitudinally within the valve body and having opposite ends;

the shuttle is placed in the bore for sliding movement therein between said opposite ends;

the valve includes two second passages and a valve seat adjacent each of said opposite ends of the bore, each said valve seat having a seating portion at the chamber and a conduit extending between one of said second passages and the seating portion;

said shuttle having sealing members, one aligned with the conduit at the seating portion of each valve seat such that movement of the shuttle between the first and second positions thereof will move one sealing member out of and into engagement with the seating portion of one valve seat for opening and closing communication between the corresponding conduit and the chamber while moving the other sealing member into and out of engagement with the seating portion of the other valve seat for closing and opening communication between the other corresponding conduit and the chamber;

the reset means exerting a biasing force upon the valve-operating lever, when the valve-operating lever is in the first position thereof, to urge said other sealing member into engagement with the seating portion of said other valve seat.

26. The invention of claim 25 wherein the reset means includes a pin carried by the trip arm and mounted for selective adjustment relative to the motion transmitting member to enable the accurate location of the first position of the valve-operating lever and adjust the biasing force exerted by the reset means at the first position of the valve-operating lever.

27. The invention of claim 14 wherein the timing device includes:

an actuator having actuating means movable between a first position and a second position;

coupling means coupling the actuating means with the motion transmitting member such that the motion transmitting member is retained in the first location thereof when the actuating means is in the first position and the motion transmitting member is free to move toward the second location thereof, under the influence of the timing means, when the actuating means is in the second position;

resilient detent means for retaining the actuating means with a predetermined retention force at the first and second positions thereof upon placement of the actuating means at either of the first and second positions; and activating means for enabling movement of the actuating means from one of the first and second positions to the other of the first and second positions by overcoming the predetermined retention force of the resilient detent means in response to activation of the actuator.

28. The invention of claim 27 wherein:

the actuator is a fluid actuator and has a piston movable within a cylinder having opposite ends, said actuating means including an actuator rod moved by the piston between said first position and said second position;

said coupling means couples the actuator rod with the motion transmitting member;

the resilient detent means includes complementary detent elements on the frame and on the actuator rod; and said activating means includes a first port for admitting a working fluid into the cylinder between the piston and one end of the cylinder and a second port for admitting a working fluid into the cylinder between the piston and the other end of the cylinder.

* * * * *